US009505110B2

(12) United States Patent
Hsieh

(10) Patent No.: US 9,505,110 B2
(45) Date of Patent: Nov. 29, 2016

(54) TORQUE WRENCH WITH DOUBLE DRIVE ENDS

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 327 days.

(21) Appl. No.: 14/472,424

(22) Filed: Aug. 29, 2014

(65) Prior Publication Data

US 2015/0059539 A1 Mar. 5, 2015

(30) Foreign Application Priority Data

Aug. 30, 2013 (TW) ..... 102131349 A

(51) Int. Cl.
*B25B 23/142* (2006.01)

(52) U.S. Cl.
CPC ..... *B25B 23/1422* (2013.01); *B25B 23/1427* (2013.01)

(58) Field of Classification Search
CPC ..... B25B 23/1422; B25B 23/1427; B25B 23/141; B25B 23/142
See application file for complete search history.

(56) References Cited

U.S. PATENT DOCUMENTS

2016/0059395 A1* 3/2016 Huguelet ..... A61C 8/0089 433/173

* cited by examiner

*Primary Examiner* — David B Thomas
(74) *Attorney, Agent, or Firm* — Guice Patents PLLC

(57) ABSTRACT

A torque wrench with double drive ends includes a handle having at least two hollow tubular bodies coaxially connected with each other, two drive heads respectively disposed at two ends of the handle, and a double torque adjustment mechanism including at least one adjustment member, two slide blocks and two elastic members. The two slide blocks are movable within the two tubular bodies. The adjustment member is positioned between the two slide blocks for driving the two slide blocks. The two elastic members are respectively positioned between the two slide blocks and the tubular bodies. By means of the adjustment member, the elastic force applied by the elastic members to the drive heads the can be adjusted to set the torque values thereof.

17 Claims, 16 Drawing Sheets

TORQUE WRENCH WITH DOUBLE DRIVE ENDS

BACKGROUND OF THE INVENTION

1. Field of the Invention

The present invention relates generally to a torque wrench, and more particularly to a torque wrench with double drive ends.

2. Description of the Related Art

FIG. 1 shows a conventional torque wrench 10 including a tubular outer handle 11 and a rod body 12 having a drive head 13 at one end. The drive head 13 serves to fit onto a threaded member. The rod body 12 is fitted in the outer handle 11 and pivotally connected therewith by means of an insertion pin 14, whereby the rod body 12 is swingable. An abutment block 15, a spring 16, a slide block 17 and a rotary button 18 are sequentially disposed in the outer handle 11 behind the rod body 12. A tubular adjustment grip 19 is fitted on the rear end of the outer handle 11. When rotating the adjustment grip 19, the slide block 17 is driven to axially move within the outer handle 11. The slide block 17 can be positioned in different positions to compress the spring 16 to different extents. Accordingly, the spring 16 can apply different elastic forces to the abutment block 15 to make the front end of the abutment block 15 in elastic abutment with the rear end of the rod body 12. The elastic force of the spring 16 is exactly the set torque value of the torque wrench. After the setting of the torque value is completed, the rotary button 18 is rotated to fix the adjustment grip 19.

When a user fits the drive head 13 onto a threaded member to wrench the same, in the case that the wrenching force of the wrench is greater than the set torque value of the wrench, the rod body 12 will swing and the rod body 12 will skip over the abutment block 15. Under such circumstance, the operator can know that the wrenching force has exceeded the set torque value. On the contrary, in the case that the rod body 12 does not skip over the abutment block 15, this means the wrenching force is within the set torque value range.

The conventional torque wrench has only one drive head. No torque wrench with double drive heads has been disclosed.

SUMMARY OF THE INVENTION

It is therefore a primary object of the present invention to provide a torque wrench with double drive ends. Two ends of the torque wrench are respectively provided with two drive heads. The torque values of the two drive heads are settable.

It is a further object of the present invention to provide the above torque wrench with double drive ends, in which the torque values of the two drive heads can be set at the same time.

It is still a further object of the present invention to provide the above torque wrench with double drive ends, in which the torque values of the two drive heads can be respectively set.

To achieve the above and other objects, the torque wrench with double drive ends of the present invention includes: a handle having at least two hollow tubular bodies coaxially connected with each other; two drive heads respectively disposed at two ends of the handle; and a double torque adjustment mechanism including at least one adjustment member, two slide blocks and two elastic members. The adjustment member is disposed on the handle for manual operation. The two slide blocks and the two elastic members are respectively disposed in the two tubular bodies of the handle. The two slide blocks are movable within the two tubular bodies along the tubular bodies. The adjustment member is positioned between the two slide blocks. The two slide blocks abut against the inner ends of the two elastic members. The two elastic members apply elastic force to the two drive heads. The adjustment member serves to drive the two slide blocks to move so as to change the elastic force applied by the elastic members to the drive heads.

Each of two ends of the torque wrench has a drive head. The adjustment member serves to adjust/set the torque values of the drive ends.

Preferably, the adjustment member is able to simultaneously drive the two slide blocks to set the torque values of the two drive heads at the same time.

Preferably, the adjustment member is able to respectively adjust/set the torque values of the two drive heads.

The present invention can be best understood through the following description and accompanying drawings, wherein:

DETAILED DESCRIPTION OF THE PREFERRED EMBODIMENTS

Figure 1:
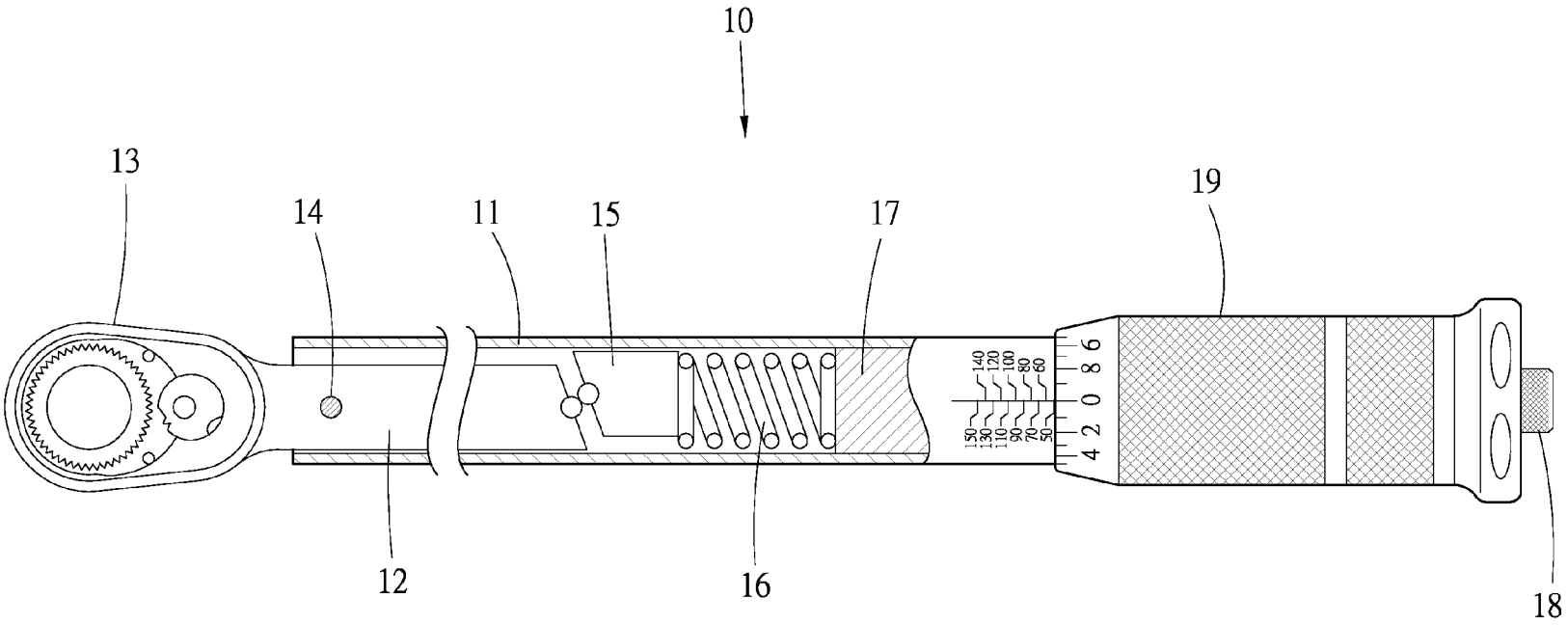
Fig. 1 PRIOR ART
FIG. 1 is a partially sectional view of a conventional torque wrench.
Figure 2:
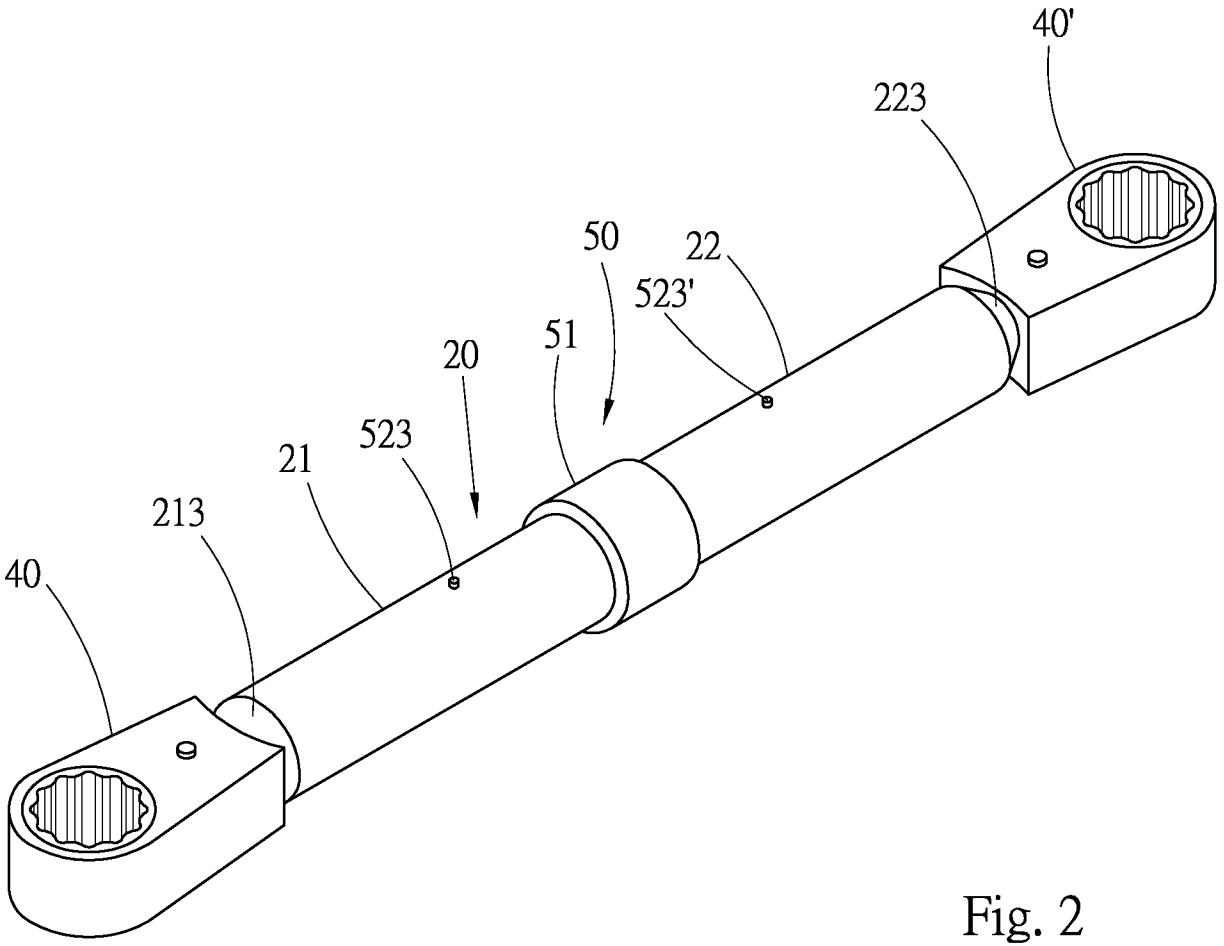
FIG. 2 is a perspective assembled view of a first embodiment of the torque wrench of the present invention.
Figure 3:
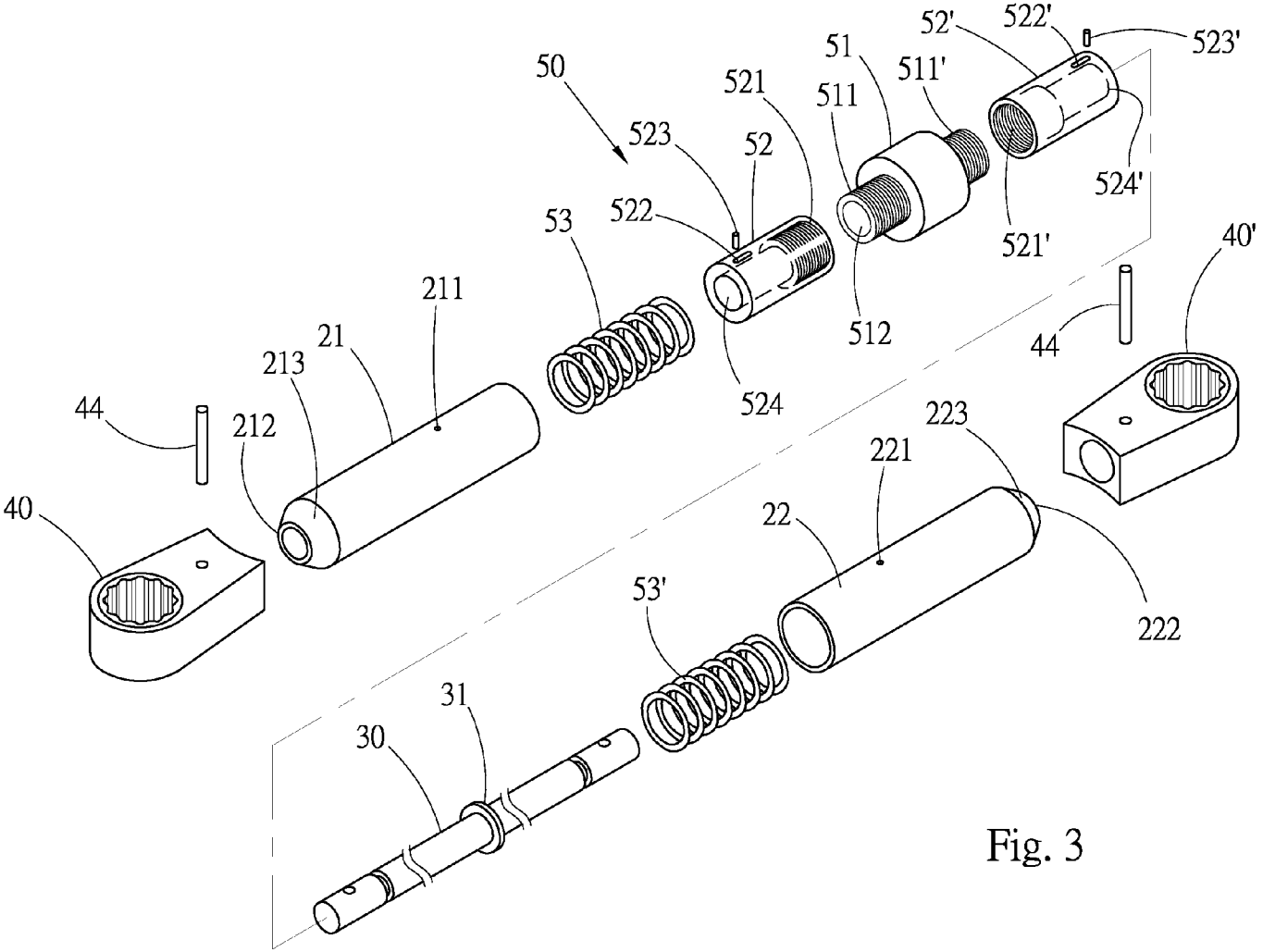
FIG. 3 is a perspective exploded view of the first embodiment of the torque wrench of the present invention.
Figure 4:
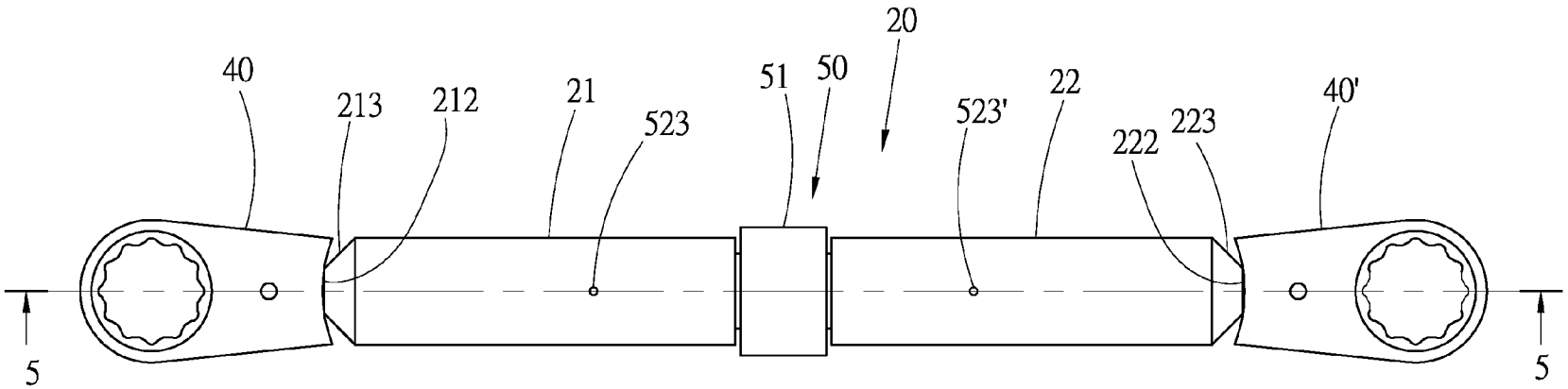
FIG. 4 is a top view according to FIG. 2.

Please refer to FIGS. 2 to 5. According to a first embodiment, the torque wrench with double drive ends of the present invention includes a handle 20 having a first tubular body 21 and a second tubular body 22 coaxially connected with each other. The circumferences of the two tubular bodies 21, 22 are respectively formed with a first locating hole 211 and a second locating hole 221. Outer ends of the two tubular bodies 21, 22 are formed with conic configurations. The conic outer ends of the tubular bodies respectively have a first abutment end face 212 and a second abutment end face 222 and a first bevel face 213 and a second bevel face 223.

Figure 5:
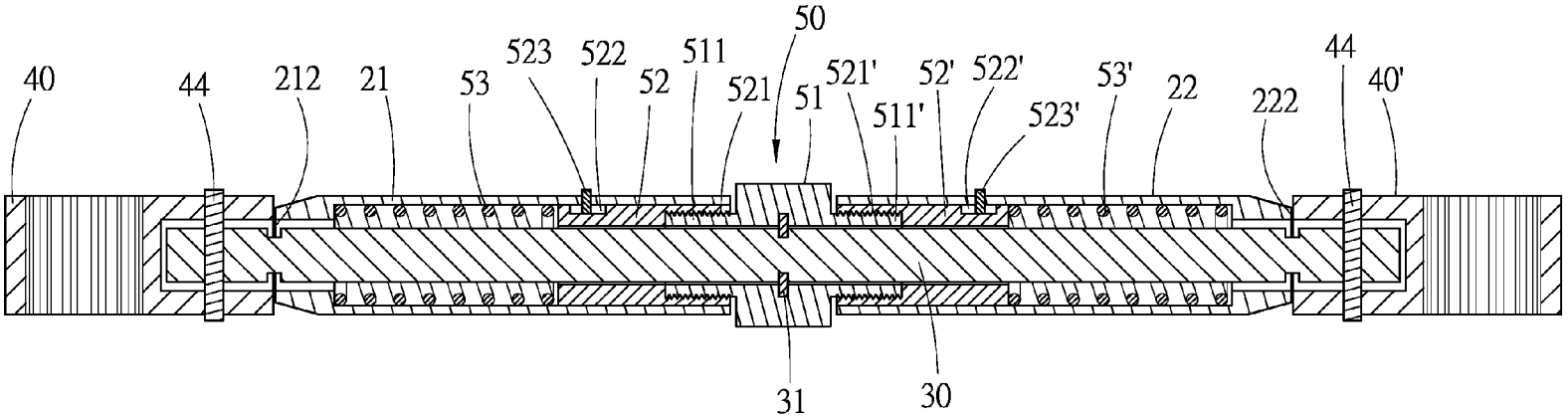
FIG. 5 is a sectional view taken along line 5-5 of FIG. 4.

The torque wrench of the present invention further includes a rod body 30. Two ends of the rod body 30 respectively pass through the first and second tubular bodies 21, 22 of the handle 20 as shown in FIG. 5. The two ends of the rod body 30 protrude from the outer ends of the two tubular bodies 21, 22. The two tubular bodies 21, 22 are slidable relative to the rod body 30.

The torque wrench of the present invention further includes two drive heads 40, 40' for fitting onto a threaded member (bolt or nut) or connecting with a socket. The two drive heads 40, 40' can have different configurations not limited to this embodiment. For example, the drive heads can be open end, double-offset ring, ratcheted structure or socket of a wrench. In this embodiment, the drive heads are a first drive head 40 and a second drive head 40', which are double-offset rings. Each drive head is pivotally swingably connected with one of two ends of the rod body 30 via a pin member 44. The two drive heads are respectively positioned at two ends of the handle.

The torque wrench of the present invention further includes a double torque adjustment mechanism 50 disposed in the handle 20. The double torque adjustment mechanism 50 includes an adjustment member 51, a first slide block 52, a second slide block 52', a first elastic member 53 and a second elastic member 53'. The adjustment member 51 is disposed between the inner ends of the first and second tubular bodies 21, 22 of the handle 20. Two ends of the adjustment member 51 are respectively provided with a first adjustment section and a second adjustment section. In this embodiment, the two adjustment sections are respectively a first threaded rod 511 and a second threaded rod 511'. The adjustment member 51 is formed with an internal passage 512 passing through the adjustment member 51 from one end to the other end thereof.

The two slide blocks 52, 52' are hollow sleeve bodies each having a passageway 524, 524'. The two slide blocks 52, 52' are respectively disposed in the two tubular bodies 21, 22 and slidable within the tubular bodies 21, 22. The circumferences of the two slide blocks 52, 52' are respectively formed with a first slide slot 522 and a second slide slot 522'. A first thread 521 and a second thread 521' are respectively formed on inner circumferences of the two slide blocks 52, 52'. Two insertion pins 523, 523' are respectively passed through the two locating holes 211, 221 of the two tubular bodies 21, 22 and inlaid in the slide slots 522, 522' of the two slide blocks 52, 52', whereby the two slide blocks 52, 52' are prevented from rotating. The two threaded rods 511, 511' of the adjustment member 51 are respectively screwed in the threads 521, 521' of the two slide blocks.

The two elastic members 53, 53' are respectively disposed in the two tubular bodies 21, 22 and positioned between the outer ends of the two slide blocks 52, 52' and the outer ends of the two tubular bodies. Two ends of the elastic members 53, 53' respectively abut against the outer ends of the slide blocks 52, 52' and the outer ends of the two tubular bodies 21, 22. The two elastic members provide elastic energy to make the abutment end faces 212, 222 of the tubular bodies 21, 22 respectively abut against the inner ends of the two drive heads 40, 40'.

The rod body 30 is passed through the passage 512 of the adjustment member 51, the two slide blocks 52, 52' and the two elastic members 53, 53' of the double torque adjustment mechanism 50. The adjustment member is fitted on the rod body. A locating member 31 such as a C-shaped retainer ring or an anti-slip bearing is disposed between the rod body 30 and the adjustment member 51, whereby the adjustment member 51 can only rotated around the rod body 30 without possibility of move along the rod body 30.

Figure 6:
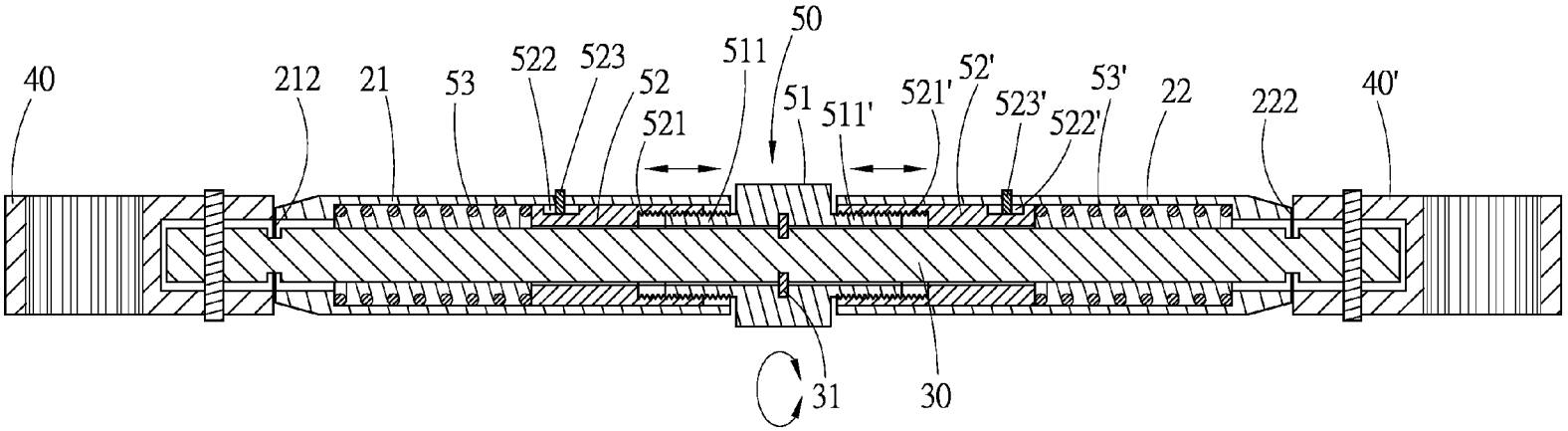
FIG. 6 is a sectional view according to FIG. 5, showing the setting of the torque value of the first embodiment of the torque wrench of the present invention.

Please now refer to FIGS. 5 and 6, which show the adjustment/setting of the torque value of the torque wrench. In this embodiment, the torque values of the two drive heads 40, 40' are set at the same time. The adjustment member 51 is rotated to rotate the first and second threaded rods 511, 511' of two ends of the adjustment member 51. Via the screwing relationship between the two threaded rods and the two threads 521, 521', the two slide blocks 52, 52' are simultaneously driven to axially slide along the rod body 30 so as to adjust the compression force applied to the two elastic members 53, 53'. The elastic force of the two elastic members 53, 53' is applied to the inner walls of the outer ends of the two tubular bodies 21, 22, whereby the abutment end faces 212, 222 of the two tubular bodies 21, 22 respectively abut against the inner ends of the two drive heads 40, 40'. Accordingly, by means of rotating the adjustment member 51, the elastic force of the two elastic members 53, 53' can be simultaneously adjusted to set the torque values of the two drive ends at the same time.

Figure 7:
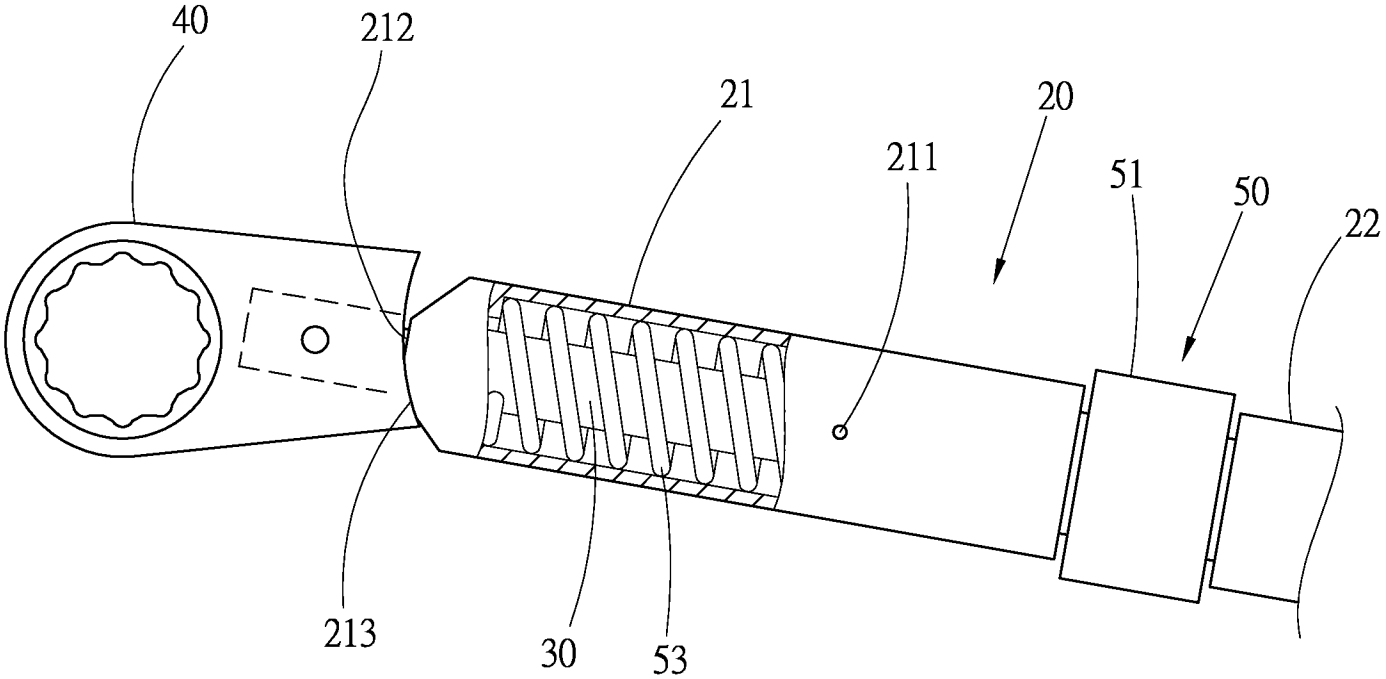
FIG. 7 is an enlarged view of a part of the first embodiment of the torque wrench of the present invention, showing that the wrenching force of the torque wrench has reached the set torque value and the drive head is bent from the handle.
Figure 8:
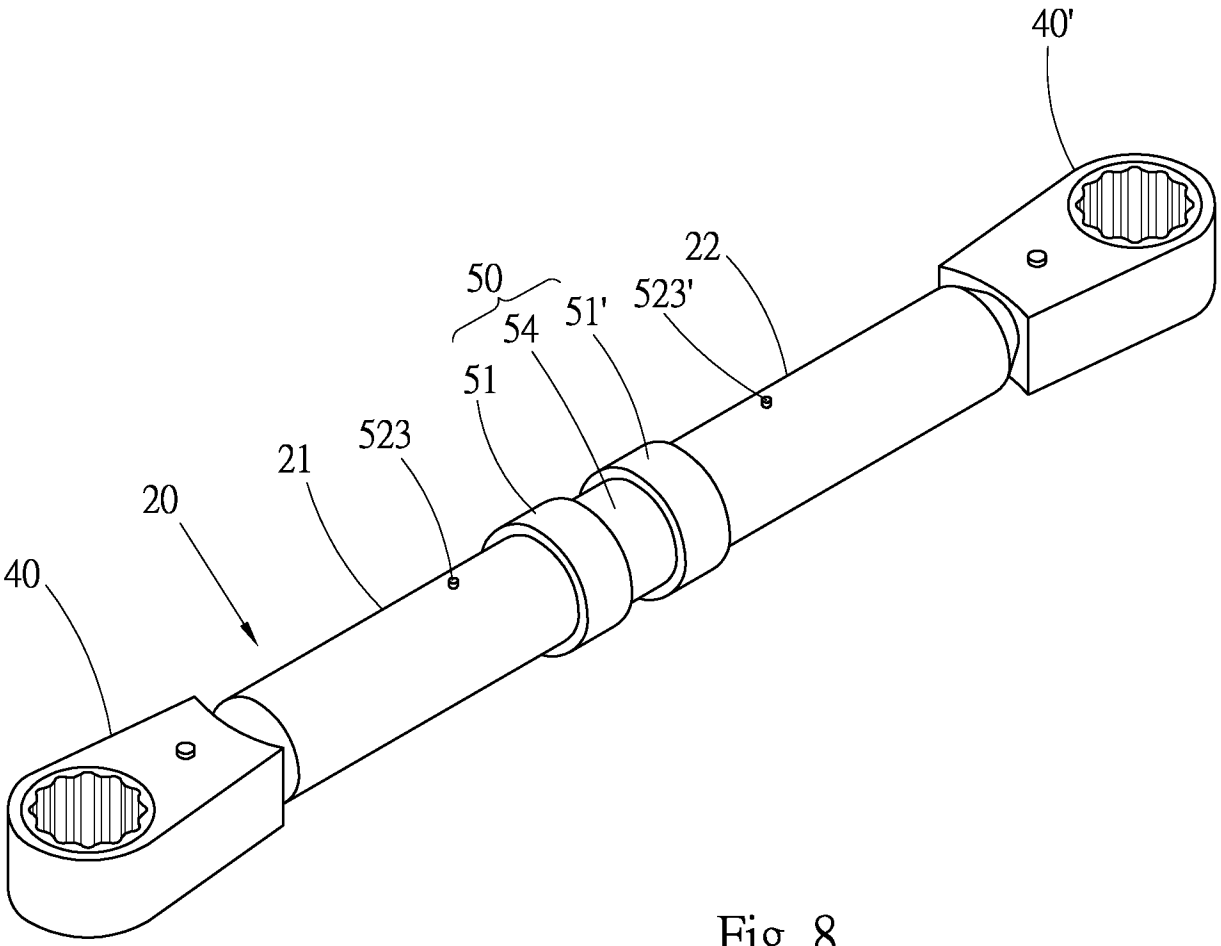
FIG. 8 is a perspective assembled view of a second embodiment of the torque wrench of the present invention.
Figure 9:
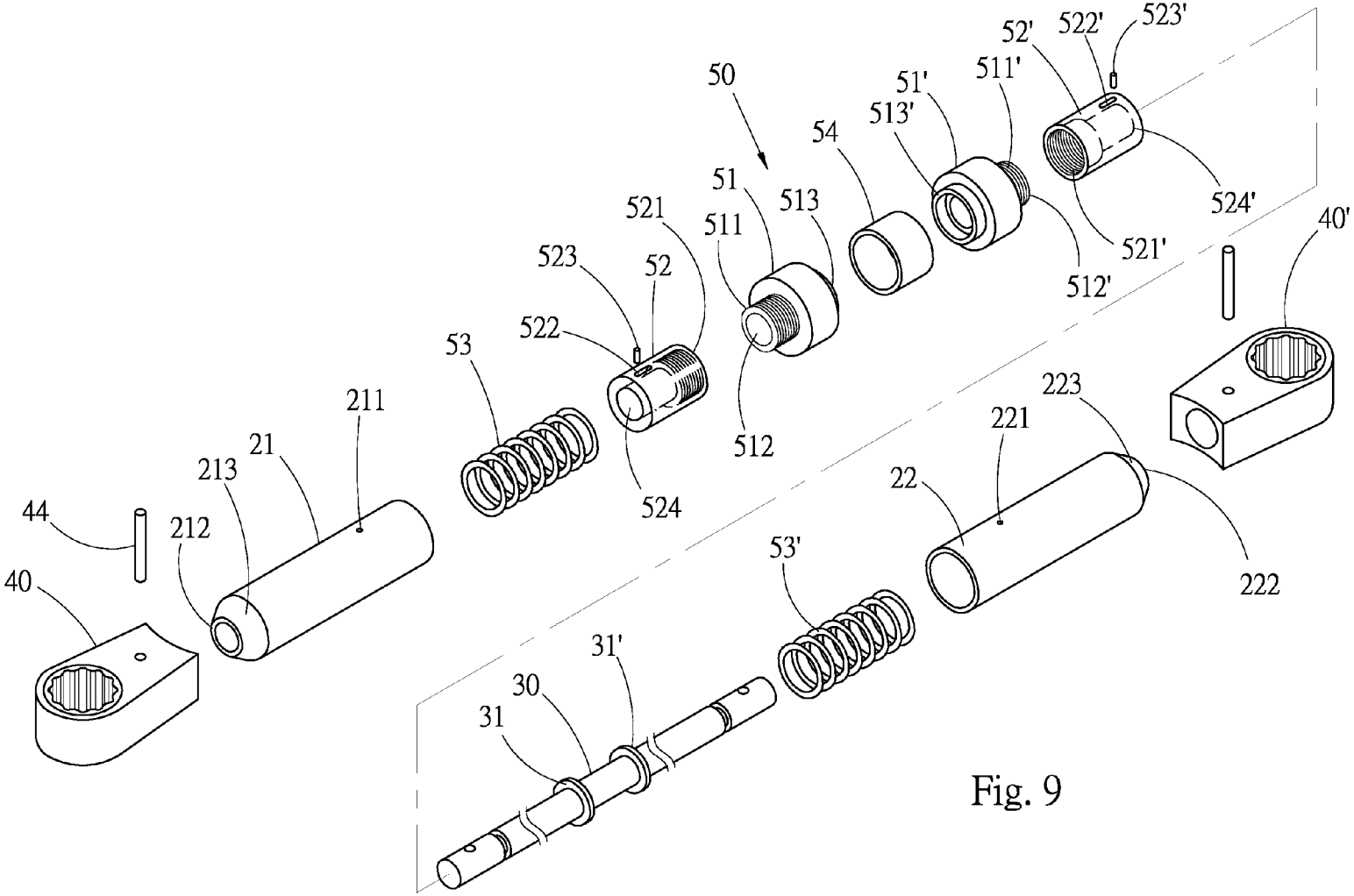
FIG. 9 is a perspective exploded view of the second embodiment of the torque wrench of the present invention.
Figure 10:
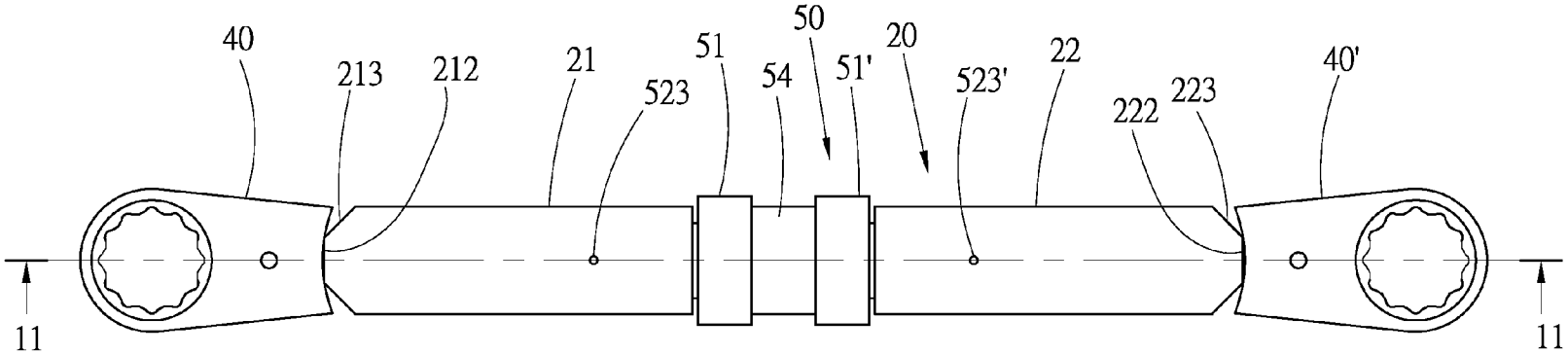
FIG. 10 is a top view according to FIG. 8.

Please now refer to FIG. 7. In use of the torque wrench, in this embodiment, with the first drive head 40 taken as an example, the first drive head 40 of the torque wrench is fitted onto a threaded member (not shown). A user holds the handle 20 to wrench the threaded member with the torque wrench. When the wrenching force of the torque wrench increases, the first tubular body 21 is moved toward the adjustment member 51 to compress the first elastic member 53. When the wrenching force of the torque wrench reaches the set torque value, the first tubular body 21 is laterally biased by an angle and the bevel face 213 of the first tubular body 21 abuts against the inner end of the first drive head 40. In appearance, the first drive head 40 is bent from the first tubular body 21. At this time, the user can realize that the wrenching force has reached the set torque value to stop operating the wrench.

Please now refer to FIGS. 8 to 11, which show a second embodiment of the torque wrench of the present invention. In this embodiment, the handle 20, the rod body 30 and the two drive heads 40, 40' are identical to those of the first embodiment and thus will not be repeatedly described. The double torque adjustment structure 50 of the second embodiment is described as follows:

The double torque adjustment structure 50 is disposed in the handle 20, including a first adjustment member 51, a second adjustment member 51', a first slide block 52, a second slide block 52', a first elastic member 53, a second elastic member 53' and a spacer ring 54. The two adjustment members 51, 51' are hollow collar bodies each having a passage 512, 512'. A hub section 513, 513' protrudes from inner end of each adjustment member. Two ends of the spacer ring 54 are fitted on the hub sections 513, 513'. The spacer ring 54 serves to space the two adjustment members 51, 51'. The two adjustment members 51, 51' are disposed between the first and second tubular bodies 21, 22 of the handle 20. The outer ends of the two adjustment members 51, 51' respectively have a first adjustment section and a second adjustment section. In this embodiment, the first and second adjustment sections are respectively a first threaded rod 511 and a second threaded rod 511'.

The two slide blocks 52, 52' are hollow sleeve bodies respectively disposed in the two tubular bodies 21, 22 and slidable within the tubular bodies 21, 22. A first thread 521 and a second thread 521' are respectively formed on inner circumferences of the two slide blocks 52, 52'. The threads 521, 521' are respectively screwed with the two threaded rods 511, 511' of the two adjustment members 51, 51'. The circumferences of the two slide blocks 52, 52' are respectively formed with a first slide slot 522 and a second slide slot 522'. Two insertion pins 523, 523' are respectively passed through the two locating holes 211, 221 of the two tubular bodies 21, 22 and inlaid in the slide slots 522, 522' of the two slide blocks 52, 52', whereby the two slide blocks 52, 52' are prevented from rotating.

The two elastic members 53, 53' are respectively disposed between the outer ends of the two slide blocks 52, 52' and the outer ends of the two tubular bodies. Inner ends of the elastic members 53, 53' respectively abut against the outer ends of the slide blocks 52, 52'. Outer ends of the elastic members 53, 53' respectively abut against the inner walls of the outer ends of the two tubular bodies 21, 22. The two elastic members provide elastic energy to make the abutment end faces 212, 222 of the tubular bodies 21, 22 respectively abut against the inner ends of the two drive heads 40, 40'.

The rod body 30 is passed through the two adjustment members 51, 51', the spacer ring 54, the two slide blocks 52, 52' and the two elastic members 53, 53' of the double torque adjustment mechanism 50. Two locating members 31, 31' are respectively disposed between the rod body 30 and the two adjustment members 51, 51', whereby the two adjustment members 51, 51' can only rotated around the rod body 30 without possibility of move along the rod body 30.

Figure 11:
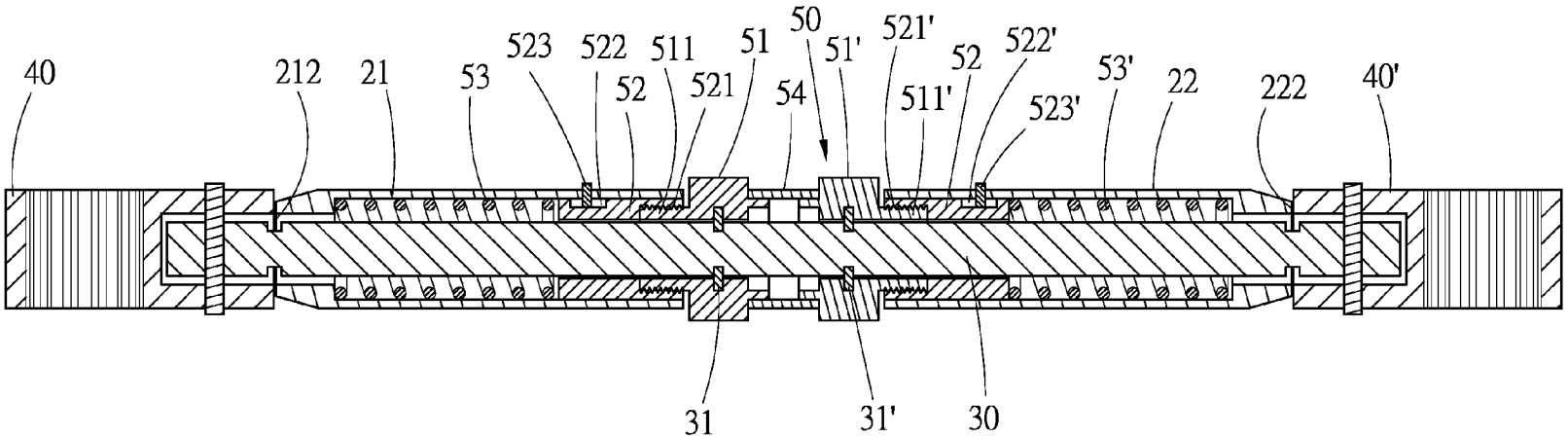
FIG. 11 is a sectional view taken along line 11-11 of FIG. 10.
Figure 12:
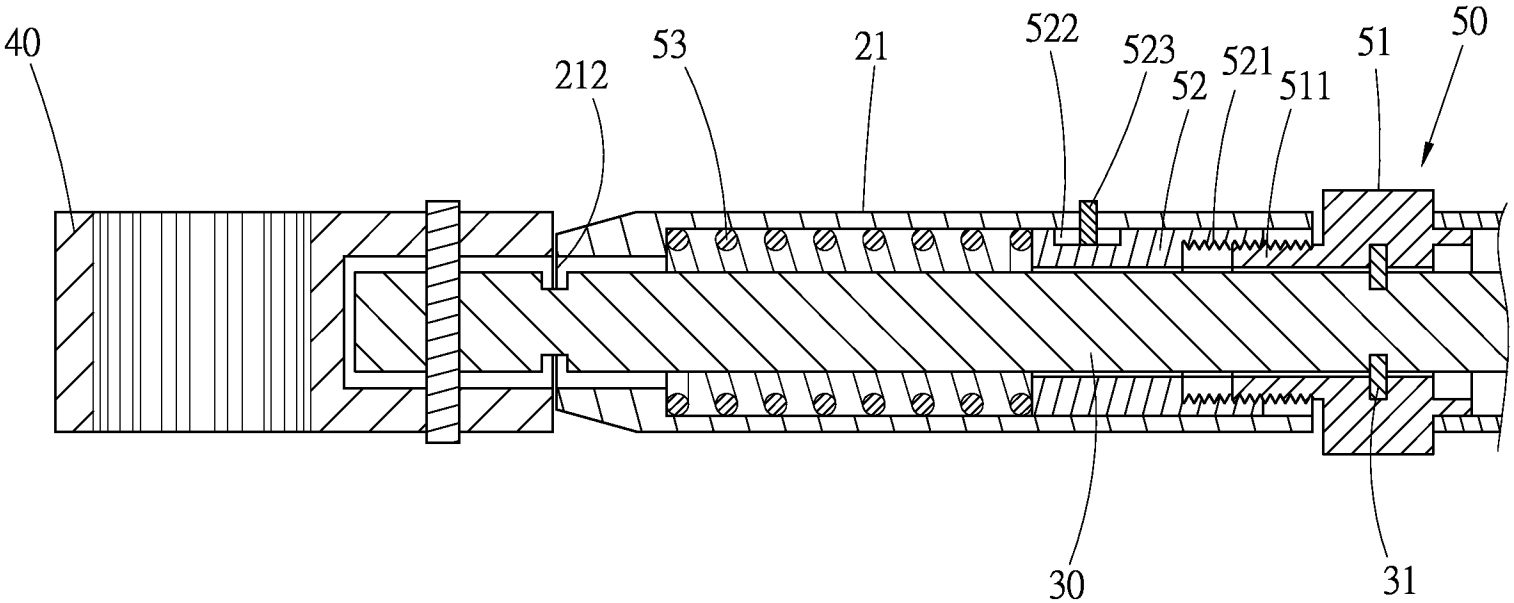
FIG. 12 is a sectional view according to FIG. 11, showing the setting of the torque value of the second embodiment of the torque wrench of the present invention.
Figure 13:
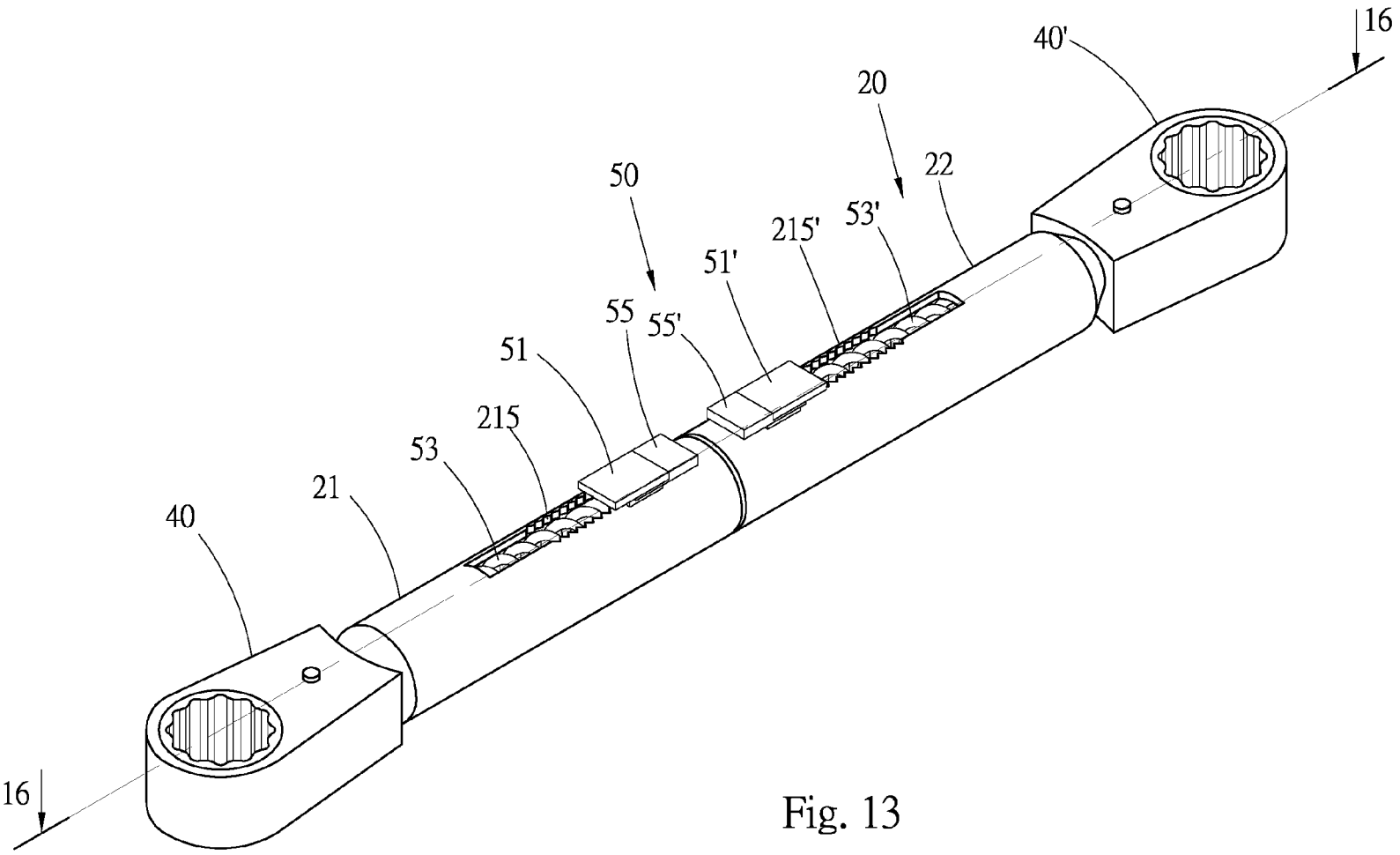
FIG. 13 is a perspective assembled view of a third embodiment of the torque wrench of the present invention.
Figure 14:
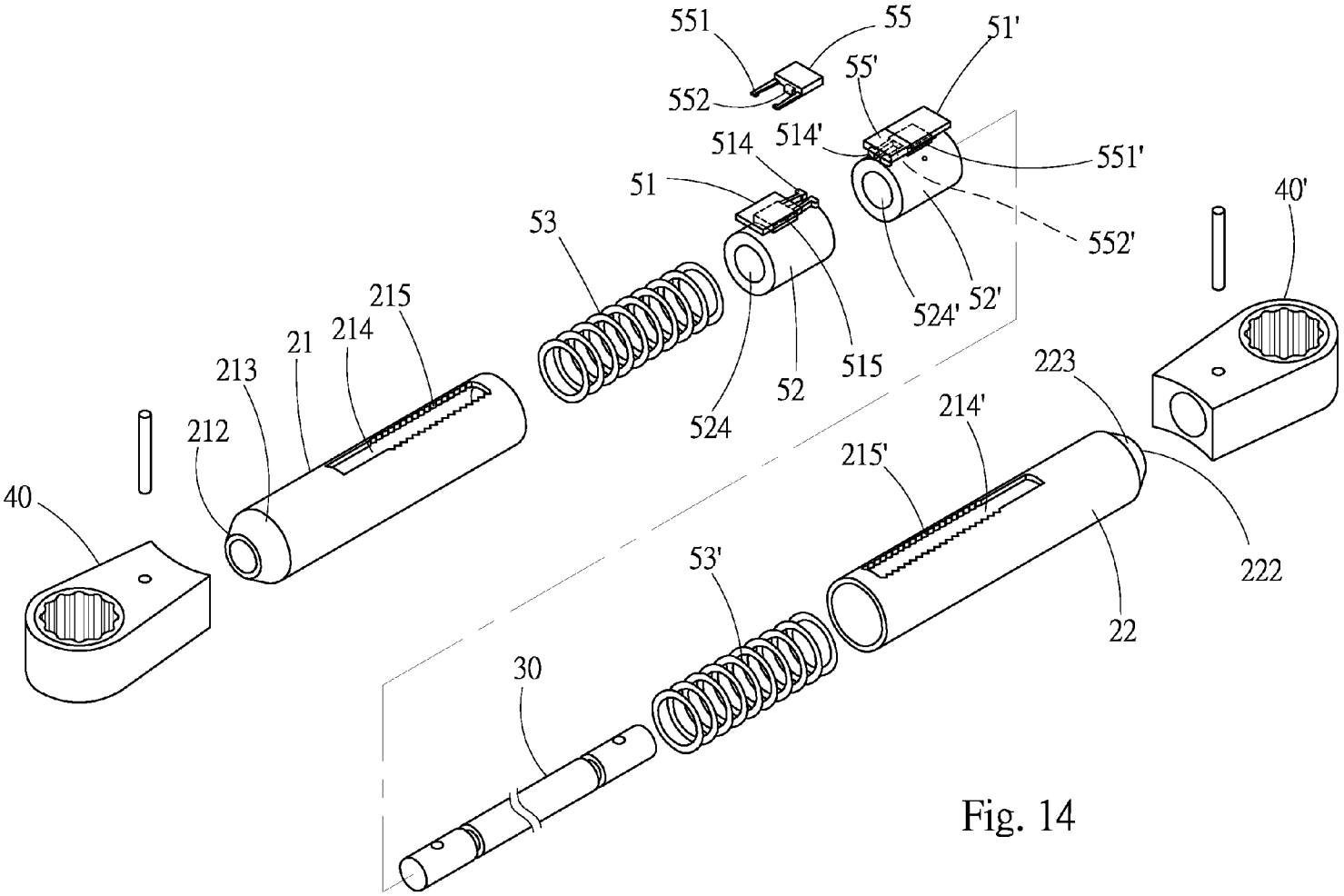
FIG. 14 is a perspective exploded view of the third embodiment of the torque wrench of the present invention.

Please refer to FIGS. 11 and 12. In this embodiment, the torque values of the two drive heads 40, 40' of the torque wrench can be independently set. With the first drive head 40 taken as an example, the first adjustment member 51 is rotated to rotate the first threaded rod 511. At this time, the first slide block 52 is driven to axially slide along the rod body 30 so as to adjust the compression force applied by the first slide block 52 to the first elastic member 53. The elastic force of the first elastic member 53 is applied to the outer end of the first tubular body 21, whereby the abutment end face 212 of the first tubular body 21 abuts against the inner end of the first drive head 40. Accordingly, by means of rotating the first adjustment member 51, the elastic force of the first elastic member 53 can be adjusted to set the torque value of the first drive head 40. Similarly, the second adjustment member 51' can be rotated to drive the second slide block 52' to slide along the rod body 30 so as to adjust the torque value of the second drive head 40'.

The operation of the second embodiment of the torque wrench of the present invention is identical to that of the first embodiment and thus will not be further described hereinafter.

Please now refer to FIGS. 13 to 16, which show a third embodiment of the torque wrench of the present invention. In this embodiment, the rod body 30 and the two drive heads 40, 40' are identical to those of the first embodiment and thus will not be repeatedly described. The handle 20 and the double torque adjustment mechanism 50 of the third embodiment are described as follows:

The first and second tubular bodies 21, 22 of the handle 20 are respectively axially formed with a first adjustment slot 214 and a second adjustment slot 214'. The edges of the two adjustment slots 214, 214' are respectively formed with rack sections 215, 215'. The teeth of the rack sections 215, 215' are arranged in the axial direction of the tubular bodies.

The double torque adjustment mechanism 50 includes a first adjustment member 51, a second adjustment member 51', a first slide block 52, a second slide block 52', a first elastic member 53, a second elastic member 53', a first locating member 55 and a second locating member 55'.

Figure 15:
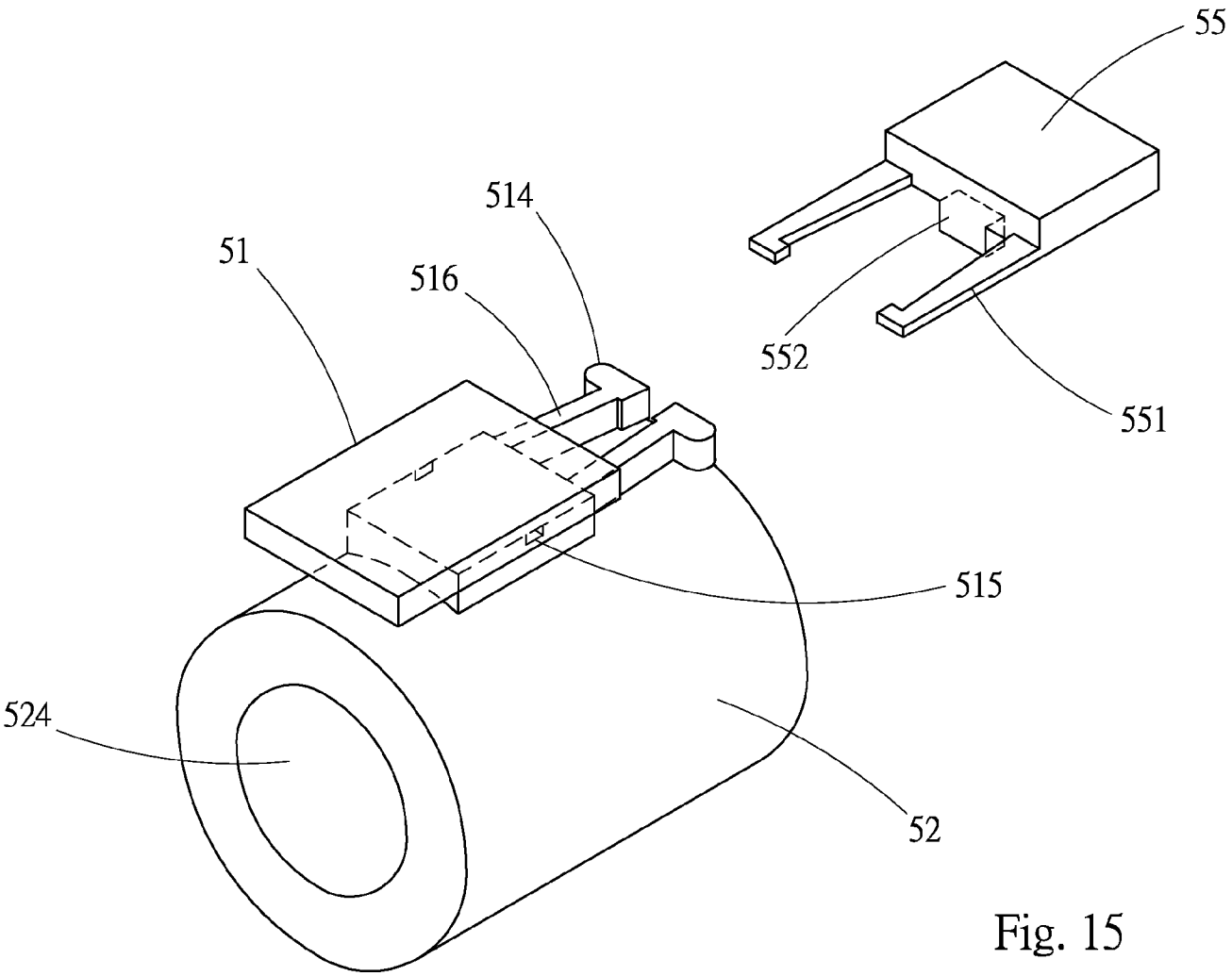
FIG. 15 is an enlarged perspective view showing the adjustment member and the locating member of the third embodiment of the present invention.
Figure 16:
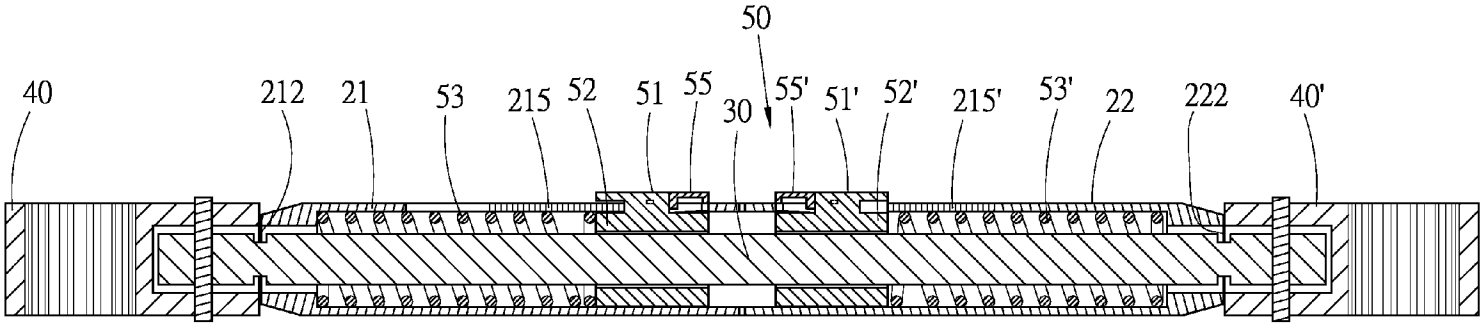
FIG. 16 is a sectional view taken along line 16-16 of FIG. 13.

Please refer to FIG. 15. Each of the two adjustment members 51, 51' has two arms 516 protruding from one end of the adjustment member. Two first engagement sections 514 and two second engagement sections 514' are respectively disposed on the two arms 516 of the adjustment members. The engagement sections and the arms can be elastically biased to two sides. Each of two sides of the adjustment member is formed with a recess 515. Two first latch sections 551 and two second latch sections 551' are respectively disposed at one end of the two locating members 55, 55'. Two engagement blocks 552, 552' are respectively disposed at one end of the two locating members 55, 55'. The engagement blocks 552 are positioned between the two first latch sections 551. The two locating members 55, 55' are respectively assembled and connected with the two adjustment members 51, 51' and relatively slidable. The two latch sections 551, 551' are movable on two lateral sides of the two adjustment members 51, 51' to latch and engage with the recesses 515 of the adjustment members 51, 51'. Each pair of engagement sections 514, 514' is positioned between each pair of latch sections 551, 551'. The bottom faces of the two adjustment members 51, 51' are respectively connected with the two slide blocks 52, 52'. The two slide blocks are respectively received in the tubular bodies 21, 22. The two adjustment members and the two locating members are received in the two adjustment slots 214, 214'.

The two elastic members 53, 53' are respectively disposed between the outer ends of the two slide blocks 52, 52' and the outer ends of the handle 20. The rod body 30 is passed through the double torque adjustment mechanism 50.

Figure 17:
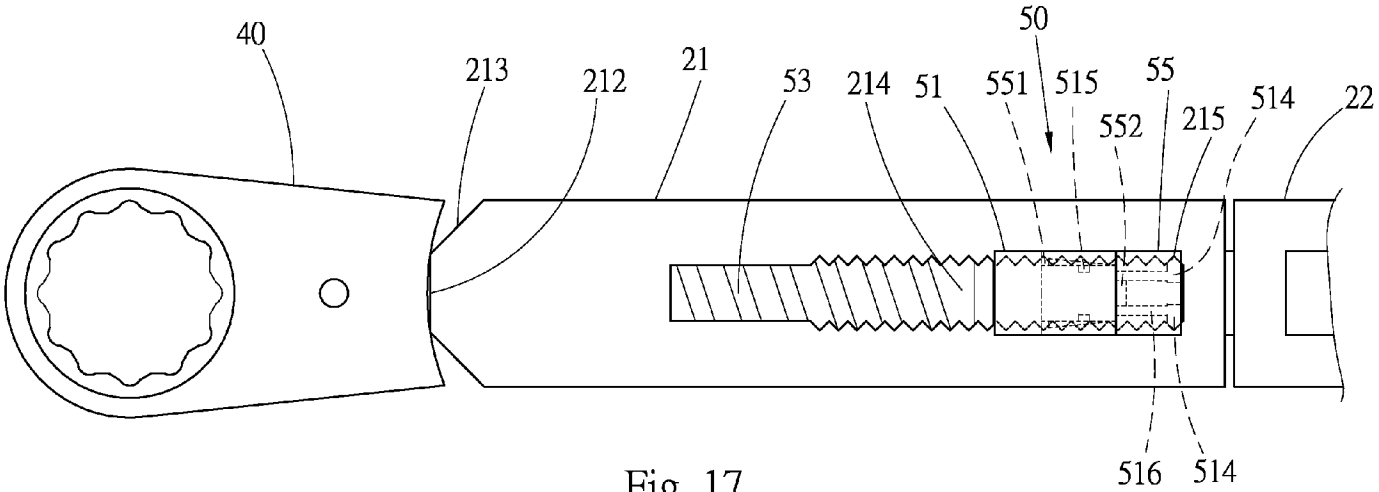
FIG. 17 is an enlarged top view of a part of FIG. 13.
Figure 18:
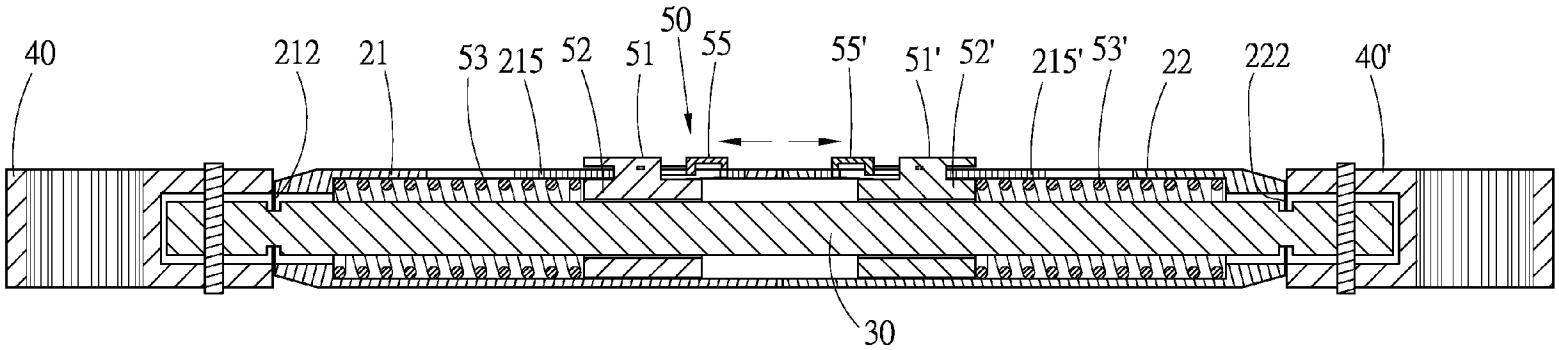
FIG. 18 is a sectional view showing the setting of the torque value of the third embodiment of the torque wrench of the present invention.
Figure 19:
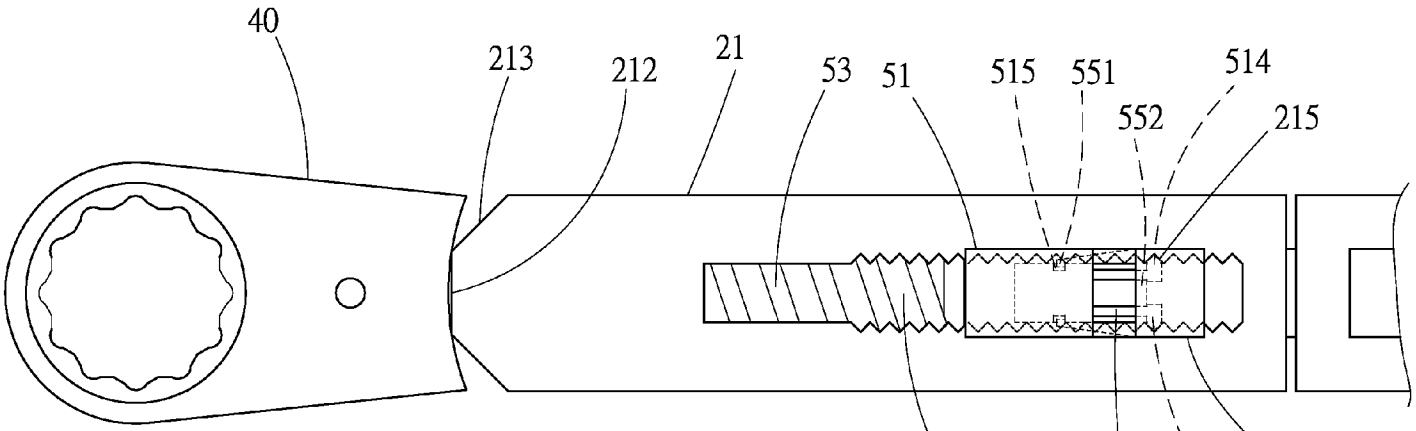
FIG. 19 is an enlarged top view of a part of FIG. 18.

Please refer to FIGS. 16 to 19. In this embodiment, the torque values of the two drive heads 40, 40' of the torque wrench can be independently set. With the first drive head 40 taken as an example, as shown in FIG. 17, the locating member 55 is moved toward the adjustment member 51. At this time, the engagement blocks 552 is moved to the root sections of the two arms 516, whereby the free ends of the arms 516 are swingable. Therefore, the two first latch sections 551 fail to latch the rack section 215 of the adjustment slot 214 and the first adjustment member 51 is movable. When the adjustment member is moved, the two latch sections 551 skip between different teeth of the rack section 215. When a user moves the first adjustment member 51, the first slide block 52 is axially moved along the tubular body 21 and the rod body 30 to change the action force applied by the first slide block 52 to the first elastic member 53 so as to adjust the torque value of the drive head 40. After the adjustment of the torque value is completed, the first locating member 55 is pushed toward the free ends of the two arms 516 to make two sides of the engagement block 552 of the first locating member abut against the free ends of the two arms 516 as shown in FIG. 19. At this time, the two first latch sections 514 keep latching with the rack section 215 of the adjustment slot 214 to locate the slide block 52. Under such circumstance, the latch sections 551 of the locating member 55 are latched in the recesses 515 of the adjustment member 51. When the locating member 55 is pushed back to the unlatched position of FIG. 17, the free ends of the arms 516 are restored to the swingable state. Under such circumstance, the engagement section 514 is unlatched from the rack section 251.

Figure 20:
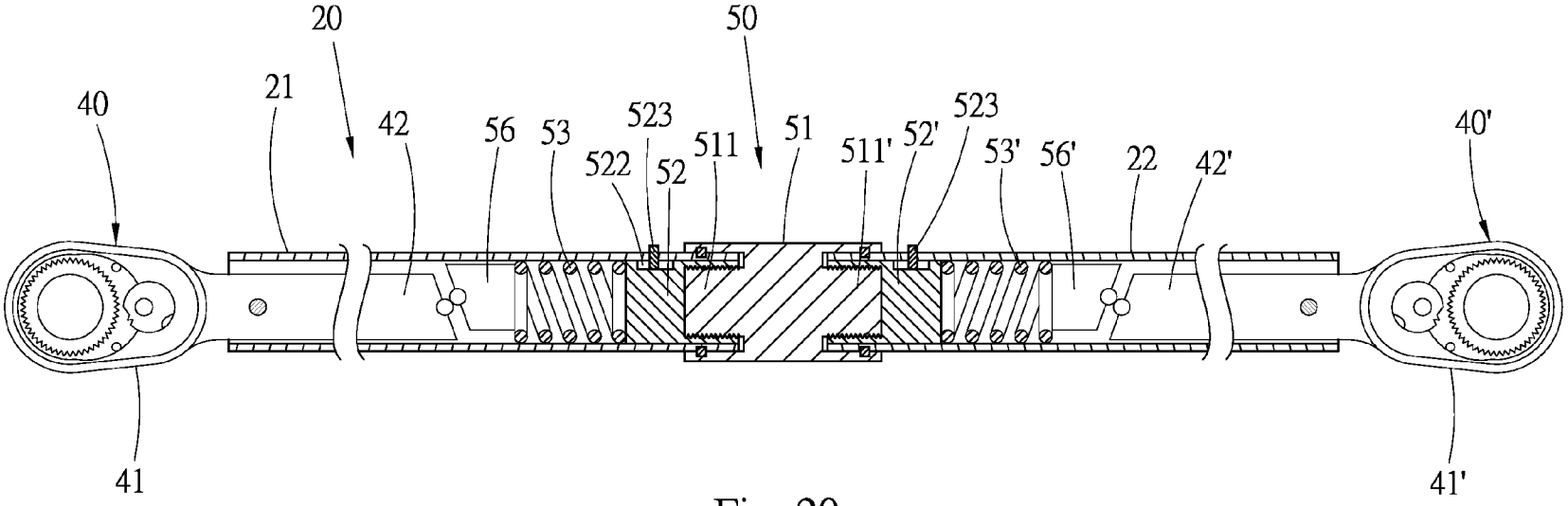
FIG. 20 is a sectional view of a fourth embodiment of the torque wrench of the present invention.

Please refer to FIG. 20, which shows a fourth embodiment of the torque wrench of the present invention. According to the fourth embodiment, the torque wrench with double drive ends of the present invention includes a handle 20 having a first tubular body 21 and a second tubular body 22 coaxially connected with each other.

The torque wrench of the present invention further includes a first drive head 40 and a second drive head 40'. Each drive head has a drive section 41, 41' and a rod section 42, 42' connected with the drive section 41, 41'. The rod sections 42, 42' of the drive heads 40, 40' are pivotally swingably connected with the outer ends of the tubular bodies 21, 22. The inner ends of the rod sections 42, 42' extend into the tubular bodies 21, 22.

Two abutment blocks 56, 56' are respectively disposed in the tubular bodies 21, 22. The outer ends of the abutment blocks are in contact with the inner ends of the rod sections 42, 42' of the drive heads 40, 40'.

A double torque adjustment mechanism 50 is disposed in the two tubular bodies 21, 22 of the handle 20, including an adjustment member 51, a first slide block 52, a second slide block 52', a first elastic member 53 and a second elastic member 53'. Two ends of the adjustment member 51 are respectively pivotally connected with the inner ends of the two tubular bodies 21, 22. Two locating members are respectively disposed between two ends of the adjustment member 51 and the two tubular bodies 21, 22, whereby the adjustment member 51 can be only rotated around the handle 30 without axially displacing along the handle. Two insertion pins 523 are disposed on the tubular bodies 21, 22 and inlaid in the slide slots of the two slide blocks 52, 52', whereby the two slide blocks 52, 52' can be only axially moved within the tubular bodies 21, 22 without possibility of rotation. Two ends of the adjustment member 51 are respectively screwed with the inner ends of the two slide blocks 52, 52'. To speak more specifically, each of two ends of the adjustment member 51 is provided with a drive section (such as a threaded rod). The threaded rods 511, 511' are respectively screwed with the threads 52, 52' of the two slide blocks 52, 52'. The two elastic members 53, 53' are respectively disposed between the outer ends of the two slide blocks 52, 52' and the inner ends of the two abutment blocks 56, 56'. Two ends of the elastic members respectively abut against the inner ends of the two abutment blocks 56, 56' and the outer ends of the two slide blocks 52, 52'.

When it is desired to adjust/set the torque values of the drive heads 40, 40' of the torque wrench, the adjustment member 51 is rotated to rotate the first and second threaded rods 511, 511' of two ends of the adjustment member 51 at the same time so as to drive the two slide blocks 52, 52' to slide along the two tubular bodies 21, 22. Accordingly, the elastic force applied by the two elastic members 53, 53' to the two abutment blocks 56, 56' can be adjusted. In this case, the elastic contact state between the two abutment blocks and the two rod sections 42, 42' can be adjusted to complete the setting of torque value.

In use, with the first drive head 40 taken as an example, when the wrenching force of the wrench reaches the set torque value, the rod section 42 will skip over the first abutment block 56 for the user to know that the wrenching force has reached the set torque value.

In conclusion, the torque wrench of the present invention has double drive ends and the torque values of the double drive ends can be set/adjusted. This structure is novel in this field.

The above embodiments are only used to illustrate the present invention, not intended to limit the scope thereof. Many modifications of the above embodiments can be made without departing from the spirit of the present invention.

What is claimed is:

1. A torque wrench with double drive ends, comprising:

a handle having at least two hollow tubular bodies coaxially connected with each other;

two drive heads respectively disposed at two ends of the handle; and a double torque adjustment mechanism including at least one adjustment member, two slide blocks and two elastic members, the adjustment member being disposed on the handle for manual operation; the two slide blocks and the two elastic members being respectively disposed in the two tubular bodies of the handle, the two slide blocks being movable within the two tubular bodies along the tubular bodies, the at least one adjustment member being positioned between the two slide blocks for driving the two slide blocks to move; the two elastic members being respectively positioned on outer sides of the two slide blocks, outer ends of the slide blocks abutting against inner ends of the elastic members, outer ends of the elastic members abutting against suitable sections in the tubular bodies, the elastic members serving to apply elastic force to the drive heads, whereby by means of the adjustment member, the elastic force of the elastic members can be adjusted to set the torque values of the drive heads.

2. The torque wrench as claimed in claim 1, further comprising:

a rod body disposed in the handle and passed through the double torque adjustment mechanism, the rod body and the two tubular bodies being relatively slidable, two ends of the rod body protruding from the two tubular bodies;

the two drive heads being respectively pivotally connected with two ends of the rod body and swingable;

the at least one adjustment member serving to drive the two slide blocks to move along the rod body, the outer ends of the two elastic members abutting against the two tubular bodies of the handle to make the outer ends of the tubular bodies elastically abut against the two drive heads respectively.

3. The torque wrench as claimed in claim 2, wherein:

the handle has two hollow tubular bodies;

the double torque adjustment mechanism having an adjustment member fitted on the rod body and positioned between the two tubular bodies of the handle, the adjustment member being only rotatable around the rod body without possibility of axial move, each of two ends of the adjustment member being provided with an adjustment section, the two adjustment sections being respectively screwed with the two slide blocks, whereby when the adjustment member is rotated, the two slide blocks are driven to slide along the rod body.

4. The torque wrench as claimed in claim 3, wherein the outer end of each tubular body has an abutment end face and a bevel face on two sides of the abutment end face, the abutment end face serving to elastically abut against the inner end of the each drive head; when the drive head is laterally biased, the drive head contacting the bevel face of the tubular body.

5. The torque wrench as claimed in claim 2, wherein:

the handle has two hollow tubular bodies;

the double torque adjustment mechanism having two adjustment members fitted on the rod body and positioned between the two tubular bodies of the handle, the two adjustment members being only rotatable around the rod body without possibility of axial move, the two slide blocks being respectively positioned at outer ends of the two adjustment members, the outer end of each adjustment member being provided with an adjustment section, the two adjustment sections being respectively screwed with the two slide blocks, whereby when the adjustment members are rotated, the two slide blocks are respectively driven to slide along the rod body.

6. The torque wrench as claimed in claim 5, wherein the outer end of each tubular body has an abutment end face and a bevel face on two sides of the abutment end face, the abutment end face serving to elastically abut against the inner end of the each drive head; when the drive head is laterally biased, the drive head contacting the bevel face of the tubular body.

7. The torque wrench as claimed in claim 2, further comprising at least one locating member disposed between the rod body and the adjustment member, the adjustment member being only rotatable around the rod body without possibility of axial move.

8. The torque wrench as claimed in claim 2, wherein:

the handle has two hollow tubular bodies, the circumference of each of the two tubular bodies being axially formed with an adjustment slot;

the double torque adjustment mechanism having two adjustment members respectively disposed in the adjustment slots and connected with the two slide blocks, the two adjustment members being respectively movable along the two adjustment slots of the tubular bodies and located in the adjustment slots, the two adjustment members serving to drive the two slide blocks to slide along the two tubular bodies respectively.

9. The torque wrench as claimed in claim 8, wherein:

the edges of the two adjustment slots of the tubular bodies of the handle are respectively formed with rack sections;

each adjustment member of the double torque adjustment mechanism being provided with at least one engagement section, the engagement section serving to engage with the rack section of the adjustment slot or disengage from the rack section.

10. The torque wrench as claimed in claim 9, wherein:

each of the two adjustment members of the double torque adjustment mechanism having two arms protruding from one end of the adjustment member, the two arms being elastically swingable; two engagement sections being respectively disposed at free ends of the arms;

each adjustment member further having a locating member, the locating member being formed with an engagement block, the locating member being connected with the adjustment member and slidable relative to the adjustment member, the engagement block being positioned between the two arms, when the engagement block abuts against the free ends of the arms, the two engagement sections being engaged with the rack section of the adjustment slot.

11. The torque wrench as claimed in claim 10, wherein the outer end of each tubular body has an abutment end face and a bevel face on two sides of the abutment end face, the abutment end face serving to elastically abut against the inner end of the each drive head; when the drive head is laterally biased, the drive head contacting the bevel face of the tubular body.

12. The torque wrench as claimed in claim 9, wherein the outer end of each tubular body has an abutment end face and a bevel face on two sides of the abutment end face, the abutment end face serving to elastically abut against the inner end of the each drive head; when the drive head is laterally biased, the drive head contacting the bevel face of the tubular body.

13. The torque wrench as claimed in claim 8, wherein the outer end of each tubular body has an abutment end face and a bevel face on two sides of the abutment end face, the abutment end face serving to elastically abut against the inner end of the each drive head; when the drive head is laterally biased, the drive head contacting the bevel face of the tubular body.

14. The torque wrench as claimed in claim 2, wherein the outer end of each tubular body has an abutment end face and a bevel face on two sides of the abutment end face, the abutment end face serving to elastically abut against the inner end of the each drive head; when the drive head is laterally biased, the drive head contacting the bevel face of the tubular body.

15. The torque wrench as claimed in claim 1, further comprising at least one locating member disposed between the rod body and the adjustment member, the adjustment member being only rotatable around the rod body without possibility of axial move.

16. The torque wrench as claimed in claim 1, wherein:

each drive head has a drive section and a rod section connected with the drive section, the rod section of the drive head being pivotally swingably connected with the outer end of the tubular body, the inner end of the rod section extending into the tubular body; the torque wrench further comprising:

two abutment blocks respectively disposed in the tubular bodies of the handle, the abutment blocks being positioned between the elastic members and the rod sections of the drive heads, the outer ends of the elastic members abutting against the inner ends of the abutment blocks, the outer ends of the abutment blocks being in elastic contact with the inner ends of the rod sections of the drive heads.

17. The torque wrench as claimed in claim 16, wherein two ends of the adjustment member of the double torque adjustment mechanism are respectively pivotally connected with the inner ends of the two tubular bodies of the handle, the adjustment member being only rotatable around the handle without possibility of move along the handle, two ends of the adjustment member being respectively screwed with the inner ends of the two slide blocks.

* * * * *